US007952265B2

(12) United States Patent
Iwaki et al.

(10) Patent No.: US 7,952,265 B2
(45) Date of Patent: May 31, 2011

(54) ELECTRON-EMITTING DEVICE AND IMAGE DISPLAY APPARATUS

(75) Inventors: Takashi Iwaki, Machida (JP); Tsuyoshi Ibe, Fujisawa (JP); Masahiro Terada, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 304 days.

(21) Appl. No.: 12/184,612

(22) Filed: Aug. 1, 2008

(65) Prior Publication Data

US 2009/0039755 A1 Feb. 12, 2009

(30) Foreign Application Priority Data

Aug. 9, 2007 (JP) ..... 2007-207347

(51) Int. Cl.
*H01J 1/62* (2006.01)

(52) U.S. Cl. ..... 313/495; 313/309; 313/310; 313/311; 313/494

(58) Field of Classification Search ..... 313/494–497, 313/309–311; 445/25
See application file for complete search history.

(56) References Cited

U.S. PATENT DOCUMENTS

| | | | | |
|---|---|---|---|---|
| 6,383,047 | B1 | 5/2002 | Minami et al. | 445/6 |
| 6,492,769 | B1 | 12/2002 | Oda et al. | 313/495 |
| 6,570,321 | B1 * | 5/2003 | Kusunoki et al. | 313/495 |
| 6,586,155 | B2 | 7/2003 | Furuse et al. | 430/270.1 |
| 6,693,375 | B1 | 2/2004 | Maruyama | |
| 6,781,667 | B2 | 8/2004 | Horiguchi et al. | 349/187 |
| 6,783,414 | B2 | 8/2004 | Minami et al. | 445/6 |
| 6,825,596 | B1 * | 11/2004 | Cathey | 313/336 |
| 6,827,619 | B2 | 12/2004 | Oda et al. | 445/6 |
| 6,833,224 | B2 | 12/2004 | Furuse et al. | 430/16 |
| 6,896,571 | B2 | 5/2005 | Mizuno et al. | 445/24 |
| 6,910,935 | B2 | 6/2005 | Arai et al. | 445/24 |
| 6,988,922 | B2 | 1/2006 | Iwaki | 445/6 |
| 6,992,434 | B2 | 1/2006 | Terada et al. | 313/495 |
| 7,074,380 | B2 | 7/2006 | Iwaki et al. | 423/447.3 |
| 7,077,716 | B2 | 7/2006 | Mizuno et al. | 445/24 |
| 7,314,768 | B2 | 1/2008 | Furuse et al. | 438/21 |
| 7,335,081 | B2 | 2/2008 | Iwaki et al. | 445/6 |
| 2003/0227251 | A1 * | 12/2003 | Ishizuka et al. | 313/495 |
| 2005/0008955 | A1 | 1/2005 | Furuse et al. | 430/12 |
| 2005/0287689 | A1 | 12/2005 | Iwaki et al. | 438/22 |

(Continued)

FOREIGN PATENT DOCUMENTS

EP 1 758 146 A2 2/2007

(Continued)

OTHER PUBLICATIONS

European Search Report dated Feb. 25, 2010.

*Primary Examiner* — Nimeshkumar D Patel
*Assistant Examiner* — Mary Ellen Bowman
(74) *Attorney, Agent, or Firm* — Fitzpatrick, Cella, Harper & Scinto

(57) ABSTRACT

An electron-emitting device, comprising:
a pair of device electrodes formed on an insulating substrate; and a conductive film formed to connect the device electrodes and having an electron-emitting portion, wherein the conductive film has a thickness of 3 nm to 50 nm and is made of precious metal and oxide of base metal, a percentage of the base metal among metals contained in the conductive film is 30 mol % or more, and the conductive film has a concentration gradient of the oxide of the base metal in a thickness direction.

4 Claims, 15 Drawing Sheets

U.S. PATENT DOCUMENTS

| | | | | |
|---|---|---|---|---|
| 2006/0045961 | A1 | 3/2006 | Furuse et al. | 427/77 |
| 2006/0057279 | A1 | 3/2006 | Terada et al. | 427/77 |
| 2006/0220526 | A1* | 10/2006 | Ryu | 313/497 |
| 2006/0228478 | A1 | 10/2006 | Iwaki et al. | 427/249.1 |

FOREIGN PATENT DOCUMENTS

| | | | |
|---|---|---|---|
| JP | 8-171850 | | 7/1996 |
| JP | 10-064408 | A | 3/1998 |
| JP | 2000-243224 | A | 9/2000 |

* cited by examiner

ELECTRON-EMITTING DEVICE AND IMAGE DISPLAY APPARATUS

BACKGROUND OF THE INVENTION

1. Field of the invention

The present invention relates to an electron-emitting device applied to a flat type image display apparatus and an image display apparatus fabricated by using the electron-emitting device.

2. Description of the Related Art

A surface conduction electron-emitting device uses a phenomenon in which electrons are emitted by passing a current through a small-area conductive film formed on a substrate in parallel to the film surface and such a conductive film generally has an electron-emitting portion formed by energization (forming) in advance. That is, a DC voltage or a very slowly rising voltage of about 1 V/min is applied to both ends of the conductive film to locally break, deform, or degenerate the conductive film, and thereby form an electron-emitting portion in an electrically high-resistance state. The electron-emitting portion has a crack produced in part of the conductive film and electrons are emitted from around the crack.

The surface conduction electron-emitting device has a simple structure and is easy to manufacture and therefore, a large number of devices can advantageously be arranged in a large area. Thus, various applications making use of this feature are now under study. The applicant concerned has proposed, as a manufacturing method of a surface conduction electron-emitting device advantageous for a large area, a method of forming a conductive film without relying on the sputtering method or evaporation method using a vacuum. An example thereof is a method by which a solution containing organic metal is applied onto a substrate by a spinner and then, the solution is patterned to a desired shape and the organic metal is pyrolytically decomposed to obtain a conductive film made of fine particles. Further, the applicant concerned has proposed in Japanese Patent Application Laid-Open No. 8-171850 a method by which a conductive film of a desired shape is formed by applying droplets of a solution containing organic metal onto a substrate by the inkjet method such as the bubblejet (registered trademark) method and the piezojet method.

A conductive film formed according to one of the above methods is a film made of fine particles of metal or metallic oxide or a highly continuous film. The conductive film is controlled to a desired range of resistance as an electron-emitting device by controlling component materials and a thickness thereof, but is required to be a thin film of several nm to several tens of nm from the viewpoint of the forming process and electron emission efficiency. Fluctuations in resistance of a conductive film need to be suppressed, though the film is thin, from the viewpoint of stability of electron emission characteristics and suppression of fluctuations. In addition, the conductive film is required to have high resistance of about 10 kΩ/sq to several hundreds of kΩ/sq as sheet resistance.

However, a conductive film formed according to one of the above methods and having metal as a main component cannot be used because, if the thickness thereof is several nm or less, resistance thereof fluctuates wildly. If the conductive film has a thickness of several nm or more showing stable resistance, only a low-resistance film of several kΩ/sq or less as sheet resistance can be obtained. If a conductive film is mainly made of metallic oxide and has a thickness of several nm or less, such a thin film cannot be used either because resistance thereof fluctuates wildly. Further, if the conductive film has a thickness of several nm or more showing stable resistance, resistance thereof fluctuates wildly depending on whether moisture or the like is adsorbed on the surface. Even if stabilizing treatment such as vacuum baking is performed, a portion of the film is reduced. Thus, a conductive film of high resistance of about 10 kΩ/sq to several hundreds of kΩ/sq as sheet resistance with stability could not be obtained. Therefore, a problem sometimes arises that electron emission characteristics fluctuate significantly when an electron source in which a plurality of the electron-emitting devices is arranged is used. Also in an image display apparatus constructed by arranging the electron source and an image-forming member such as a phosphor opposite to each other, fluctuations in electron emission characteristics sometimes leads to degradation in image quality, causing a problem.

SUMMARY OF THE INVENTION

The present invention has been developed to solve the above problems and an object thereof is to provide an electron-emitting device having a conductive film that has a thickness of several nm to several tens of nm and high resistance of 10 kΩ/sq to several hundreds of kΩ/sq as sheet resistance and shows minor fluctuations in resistance.

Further, another object of the present invention is to provide an image display apparatus having excellent display quality using the electron-emitting device.

An aspect of the present invention is an electron-emitting device having a pair of device electrodes formed on an insulating substrate and a conductive film formed to connect the device electrodes and having an electron-emitting portion, wherein the conductive film has a thickness of 3 nm to 50 nm and is made of precious metal and oxide of base metal, a percentage of the base metal among metals contained in the conductive film is 30 mol % or more, and the conductive film has a concentration gradient of oxide of the base metal in a thickness direction.

Another aspect of the present invention is an image display apparatus including a first plate on which a plurality of the electron-emitting devices are arranged and a second plate on which an image display member irradiated with electrons emitted from the electron-emitting devices is arranged and which is arranged opposite to the electron-emitting devices.

Further features of the present invention will become apparent from the following description of exemplary embodiments with reference to the attached drawings.

DESCRIPTION OF THE EMBODIMENTS

A first embodiment of the present invention is an electron-emitting device including a pair of device electrodes formed on an insulating substrate and a conductive film formed to connect the device electrodes and having an electron-emitting portion, wherein the conductive film has a thickness of 3 nm to 50 nm and is made of precious metal and oxide of base metal (base metal oxide), a percentage of the base metal among metals contained in the conductive film is 30 mol % or more, and there is a concentration gradient of the base metal oxide in a thickness (or depth) direction.

A second embodiment of the present invention is an image display apparatus including a first plate on which a plurality of the electron-emitting devices are arranged and a second plate on which an image display member irradiated with electrons emitted from the electron-emitting devices is arranged and which is arranged opposite to the electron-emitting devices.

According to the present invention, an electron-emitting device including a conductive film having a thickness of 3 nm to 50 nm and uniform sheet resistance of 10 kΩ/sq to several hundreds of kΩ/sq can be formed so that an electron-emitting device having less fluctuations in electric properties and better electric properties can be obtained. As a result, an image display apparatus with less fluctuations and higher quality can be obtained.

Preferable embodiments of the present invention will exemplarily be described below in detail with reference to drawings. However, dimensions, material, shapes, relative configurations and the like of the following embodiments are not intended to limit the scope of the present invention to these values.

An electron-emitting device in the present invention basically has a pair of device electrodes on an insulating substrate and a conductive film formed to connect the device electrodes and an electron-emitting portion is formed in the conductive film.

Figure 1A:
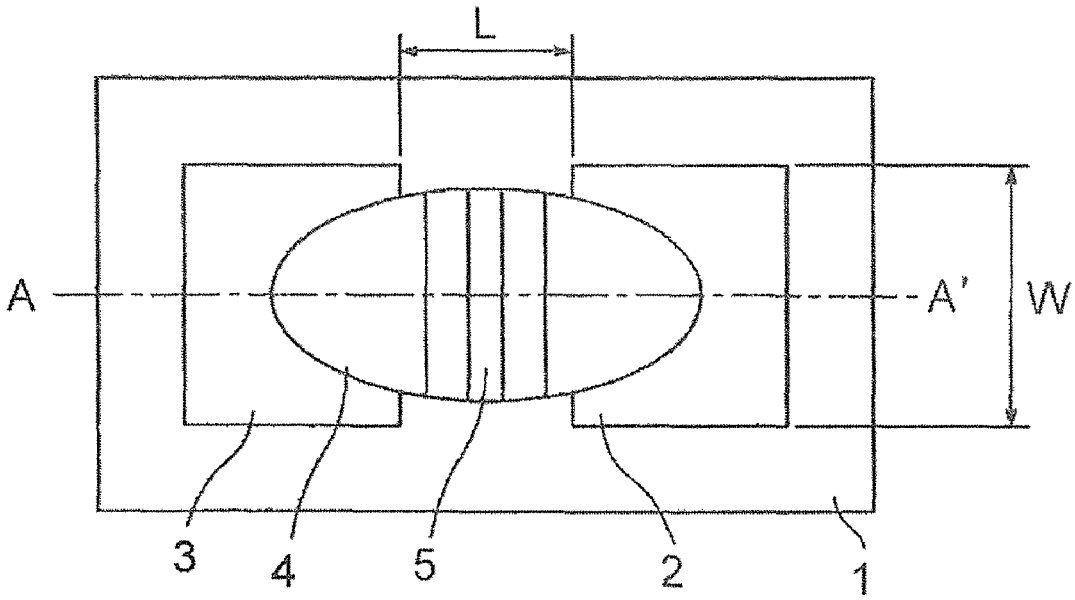
FIG. 1A and FIG. 1B are diagrams schematically showing the configuration of an example of an electron-emitting device in the present invention.
Figure 1B:
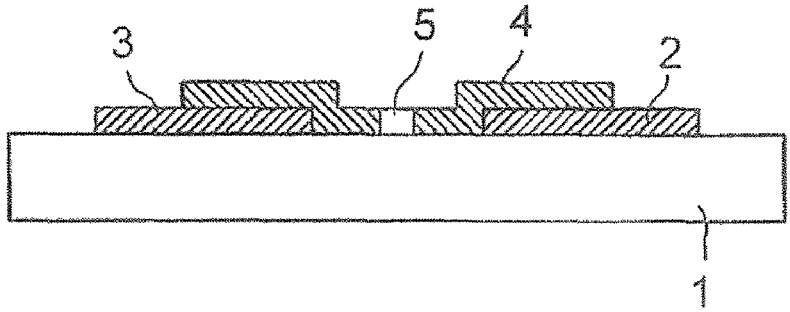

FIG. 1A and FIG. 1B schematically show a configuration example of an electron-emitting device in the present invention. FIG. 1A is a plan view and FIG. 1B is a sectional view taken along line A-A' in FIG. 1A. In these figures, reference numeral 1 denotes an insulating substrate, reference numerals 2 and 3 denote device electrodes, reference numeral 4 denotes a conductive film, and reference numeral 5 denotes an electron-emitting portion formed in the conductive film.

The substrate 1 includes, for example, quartz glass, glass in which impurity content such as Na is reduced, soda-lime glass, a glass substrate with $SiO_2$ formed on the surface thereof, and a ceramic substrate such as alumina. If necessary, after the substrate being sufficiently cleaned, a silane coupling agent is used to make the surface of the substrate hydrophobic.

Materials of the device electrodes 2, 3 include metals such as Pd, Pt, Ru, Ag, Au, Ti, In, Cu, Cr, Fe, Zn, Sn, Ta, W, and Pb, and oxides such as PdO, $SnO_2$, $In_2O_3$, PbO, and $Sb_2O_3$. Also, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, and HfN, semiconductors such as Si and Ge, and carbon are also included.

A distance L between the device electrodes 2, 3 is several hundreds of Å to several hundreds of μm. The voltage applied between the device electrodes 2, 3 is preferably low and fabrication with reproducibility is required and thus, the preferable distance L is several hundreds of Å to several μm.

The conductive film 4 according to the present invention is made of precious metal and base metal oxide and is characterized in that the percentage of the base metal among metals contained in the conductive film 4 is 30 atomic % or more and there is a concentration gradient of the base metal oxide in a thickness direction. At least one selected from Pt, Pd, Ir, and Rh is preferably used as the precious metal and at least one selected from V, Cr, Ti, Mg, Mo, Ca, Ba, Y, and In is preferably used as the base metal.

As described above, the conductive film 4 of an electron-emitting device is required to have a thickness of several nm to several tens of nm from the viewpoint of the forming process and electron emission efficiency regardless of which method is used. From the viewpoint of stability of electron emission characteristics and suppression of fluctuations of electron emission characteristics, a conductive film having high resistance of 10 kΩ/sq to several hundreds of kΩ/sq as sheet resistance and showing minor fluctuations in resistance is required. A bulk metal normally has volume resistivity of about $1\times10^{-7}$ Ωm and sheet resistance of a film simply calculated from a film thickness of 3 nm to 50 nm is 2 Ω/sq to 30 Ω/sq. It is well known that a metal film produced by a common method of manufacture such as a sputtered film, an evaporated film, and a film produced by spinning/burning has resistance increased by several times to several tens of times due to a thin film effect or the like. That is, only films of several tens of Ω/sq to several kΩ/sq are actually obtained. High-resistance films of 1 kΩ/sq or more are in a very thin state of several nm and thus, when many films are formed, such films will have great fluctuations.

As a result of an intensive research, the inventors found that thin films made of precious metal and base metal oxide have minor resistance fluctuations and that conductive films whose ratio of specific resistance to a metal bulk is 100 times to 100,000 times are obtained. That is, if the precious metal used has volume resistivity of about $1\times10^{-7}$ Ωm and the thickness of films is 3 nm to 50 nm, sheet resistance of several kΩ/sq to several hundreds of kΩ/sq with stability could be obtained and fluctuations could be reduced even when a plurality of films are produced.

Generally, when metal oxide with high resistance is gradually added to a metal, resistance of a mixture of the metal and metal oxide increases, but it is difficult to control resistance and at the same time to reduce fluctuations. In a conductive film according to the present invention, the percentage of the base metal among metals contained in the conductive film is 30 mol % or more and a concentration gradient of the base metal oxide arises in the thickness direction and therefore, the resistance will not increase too much. Thus, when the thickness of a conductive film is changed, the rate of change of thickness becomes larger than that of resistance. As a result, excellent results of minor fluctuations can conceivably be obtained in accordance with the thickness when the ratio of specific resistance to a precious metal bulk is within a range of 100 times to 100,000 times. The concentration gradient of such base metal oxide is confirmed from XPS analysis in the depth direction.

As a method of manufacture of a conductive film according to the present invention, for example, a solution containing a complex of precious metal and base metal is prepared, the solution is applied onto a substrate by spin coating or the inkjet method, and the substrate is heated and burned. By adjusting the amount of precious metal complex and that of base metal complex to a ratio necessary as a conductive film when preparing the solution, a conductive film of that ratio can be produced. When applying the solution onto the substrate by the inkjet method, the abundance of metal can be adjusted by the metal concentration of the solution and the number of times of applying droplets. A commonly used heating means may be used in a burning process and the burning temperature is 250° C. to 500° C. It is also preferable to perform UV irradiation during burning. The state of a film obtained in this manner is confirmed based on results of XPS analysis and X ray diffraction.

The forming process to form the electron-emitting portion 5 is performed to the conductive film 4 obtained as described above.

Specifically, when voltage is applied between the device electrodes 2, 3 from a power supply (not shown) under a predetermined degree of vacuum, a gap (crack) with a changed structure is formed in the conductive film 4. This gap area constitutes the electron-emitting portion 5. While electrons are emitted from the vicinity of the gap formed by the forming process under a predetermined voltage, electron emission efficiency under this condition is very low.

Figure 2A:
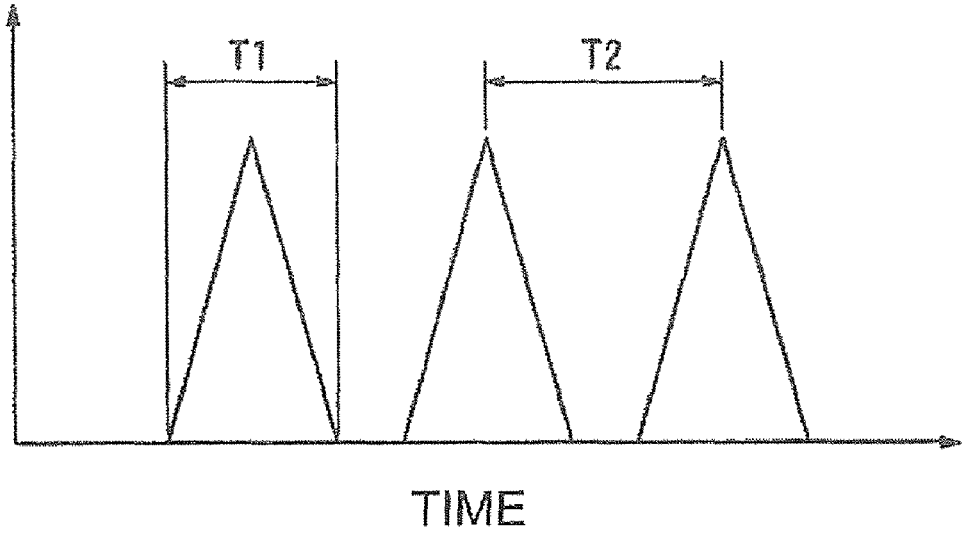
FIG. 2A and FIG. 2B are diagrams showing voltage waveforms of energization forming according to the present invention.
Figure 2B:
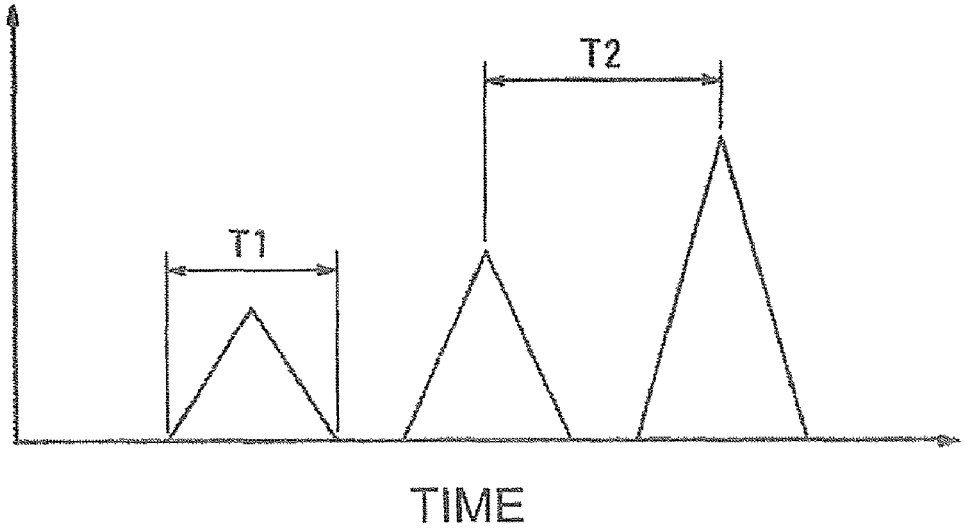

FIG. 2A and FIG. 2B show examples of voltage waveforms of energization forming. Particularly, pulse waveforms are preferable as voltage waveforms. A technique shown in FIG. 2A by which pulses with a pulse wave peak as a constant voltage are successively applied and another technique shown in FIG. 2B by which pulses are applied while increasing the pulse wave peak are known.

First, a case in which the pulse wave peak is a constant voltage will be described with reference to FIG. 2A. T1 and T2 in FIG. 2A are the pulse width and the pulse interval of voltage waveforms, respectively. Normally, T1 is set to a range of 1 μs to 10 ms and T2 to a range of 10 μs to 100 ms. The wave peak (peak voltage during energization forming) of a triangular wave is suitably selected in accordance with the configuration of the electron-emitting device. Under such conditions, the voltage is applied, for example, for several sec to several tens of min. Pulse waveforms are not limited to triangular waves and desired waveforms such as rectangular waveforms may be adopted.

Next, a case in which voltage pulses are applied while increasing the pulse wave peak will be described with reference to FIG. 2B. T1 and T2 in FIG. 2B can be the same as those shown in FIG. 2A. The wave peak (peak voltage during energization forming) of a triangular wave can be increased, for example, in increments of 0.1 V.

Energization forming can be completed when resistance is determined by measuring the current passing through a device to which the pulse voltage is being applied and the determined resistance is, for example, 1 mΩ or more.

However, electron emission efficiency in this state is very low and it is preferable to perform activation described below to increase the electron emission efficiency.

Activation is a process in which a pulse voltage is repeatedly applied between the device electrodes 2, 3 under an appropriate degree of vacuum in which a gas containing carbon atoms is present to cause carbon or carbon compounds derived from the gas to deposit as a carbon film near the gap (crack).

In the present process, for example, tolunitrile is used as a carbon source and is introduced into vacuum space through a slow leak valve to maintain the vacuum at about $1.3\times10^{-4}$ Pa. The pressure of tolunitrile to be introduced is somewhat influenced by the shape of a vacuum device and members used in the vacuum device, but is preferably $1\times10^{-5}$ Pa to $1\times10^{-2}$ Pa.

Figure 3A:
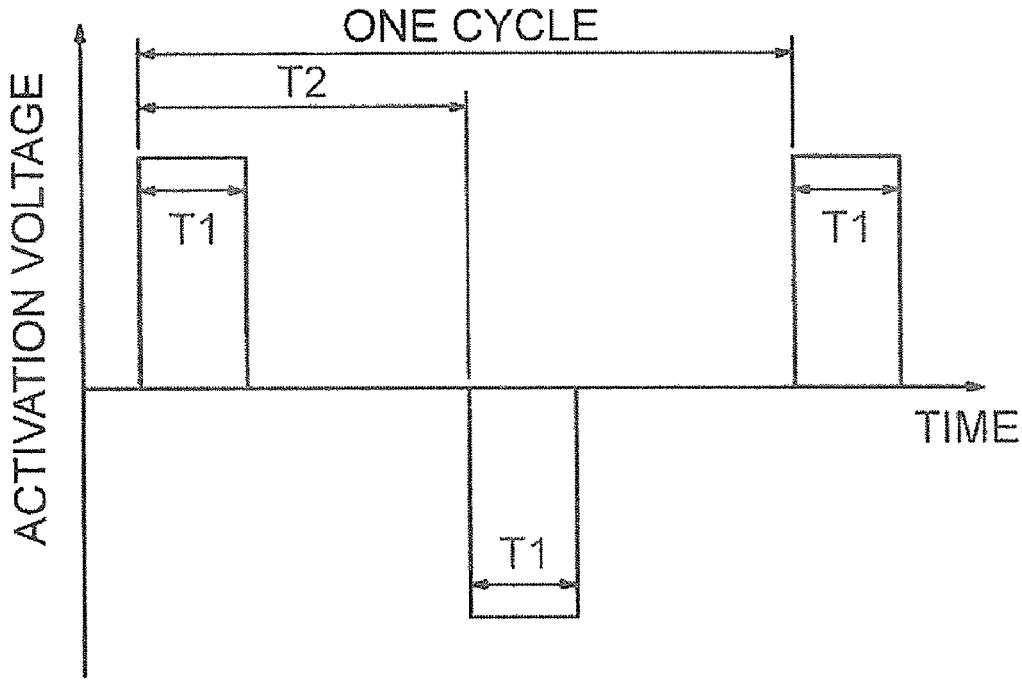
FIG. 3A and FIG. 3B are diagrams showing voltage waveforms used for activation according to the present invention.
Figure 3B:
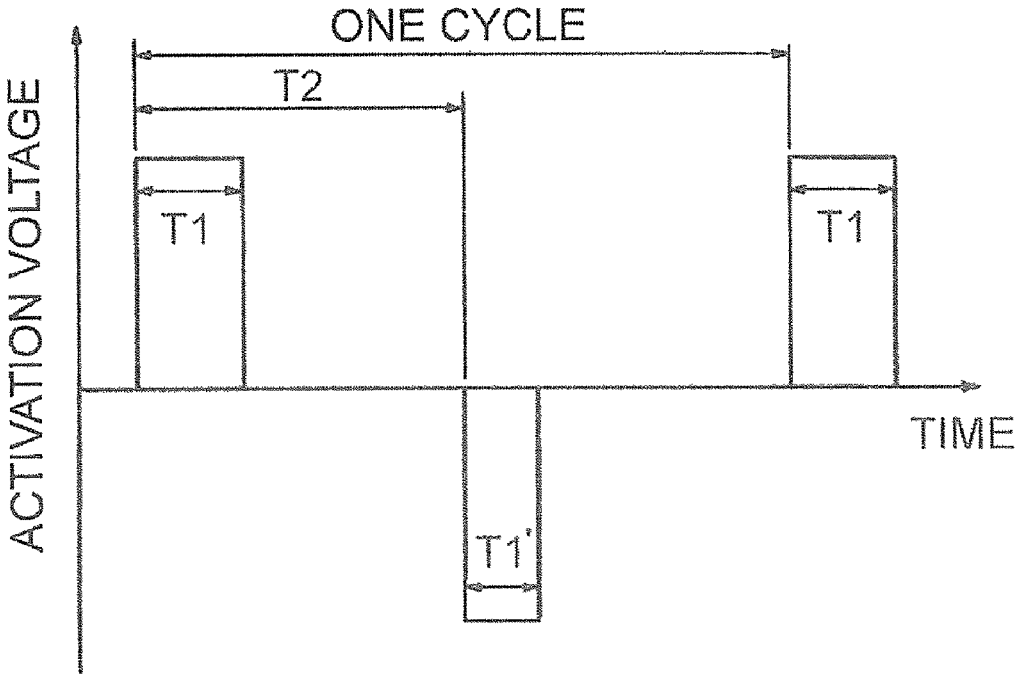

FIG. 3A and FIG. 3B show examples of desirable voltage application used in an activation process. The maximum voltage to be applied is suitably selected in the range of 10 V to 20 V.

In FIG. 3A, T1 is the pulse width of positive and negative voltage waveforms, T2 is the pulse interval, and absolute values of positive and negative voltages are set to be equal. In FIG. 3B, T1 and T1' are pulse widths of positive and negative voltage waveforms respectively with T1>T1', T2 is the pulse interval, and absolute values of positive and negative voltages are set to be equal.

In the activation, voltage application is stopped when an emission current Ie is almost saturated and then, the slow leak valve is closed to end the activation.

By performing the above process, an electron-emitting device as shown in FIG. 1A and FIG. 1B can be produced.

Basic features of the electron-emitting device produced with the device configuration and the manufacturing method described above will be described using FIG. 4 and FIG. 5.

Figure 4:
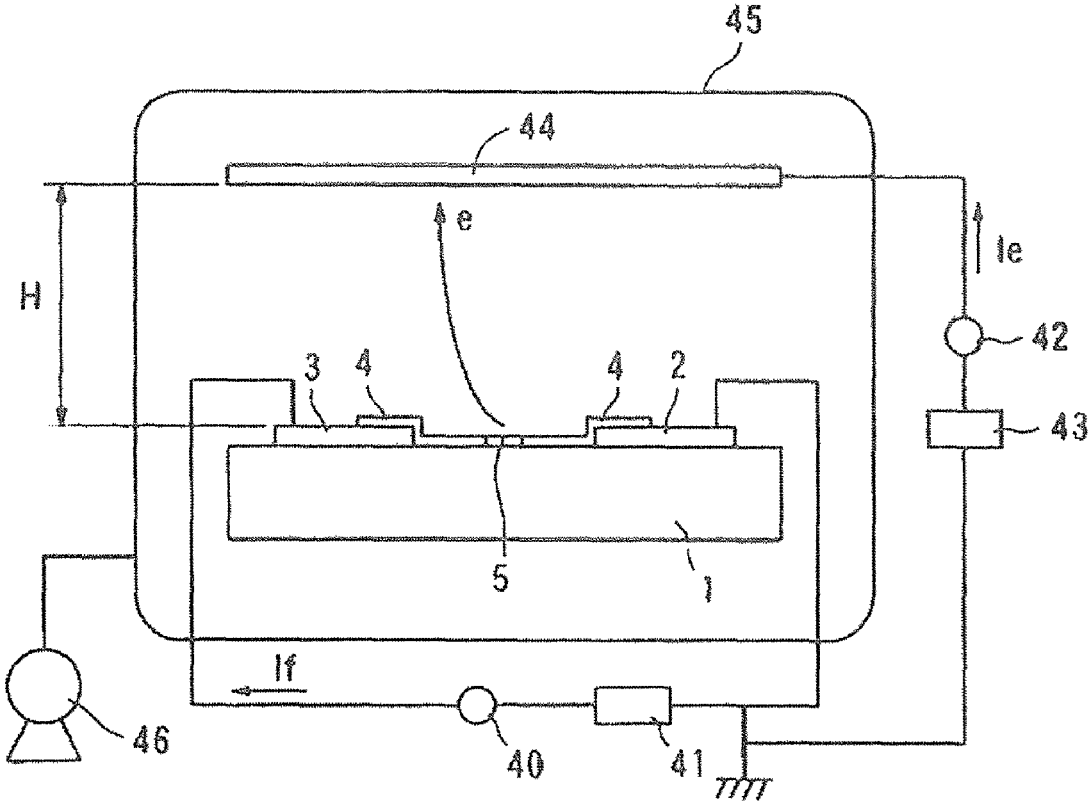
FIG. 4 is a schematic diagram of a measurement evaluation apparatus for measuring electron emission characteristics of an electron-emitting device in the present invention.

FIG. 4 is a schematic diagram of a measurement evaluation apparatus for measuring electron emission characteristics of an electron-emitting device having the above configuration. In FIG. 4, reference numeral 41 denotes a power supply for applying a device voltage Vf to the device, reference numeral 40 denotes an ammeter for measuring a device current If passing through the electrodes of the device, and reference numeral 44 denotes an anode electrode for capturing the emission current Ie emitted from an electron-emitting portion of the device. Reference numeral 43 denotes a high-voltage power supply for applying a voltage to the anode electrode 44 and reference numeral 42 denotes an ammeter for measuring the emission current Ie emitted from the electron-emitting portion of the device.

For measurement of the device current If passing through the device electrodes 2, 3 of the electron-emitting device and the emission current Ie to the anode, the power supply 41 and the ammeter 40 are connected to the device electrodes 2, 3 and the anode electrode 44 to which the power supply 43 and the ammeter 42 are connected is arranged above the electron-emitting device.

The electron-emitting device and the anode electrode 44 are set up in a vacuum device 45 and the vacuum device is equipped with a vacuum pump 46 and devices such as a vacuum gauge required for the vacuum device so that measurement evaluation can be performed in a desired vacuum.

Measurements are made by setting the voltage of the anode electrode 44 to 1 kV to 10 kV and a distance H between the anode electrode and the electron-emitting device to 2 mm to 8 mm.

Figure 5:
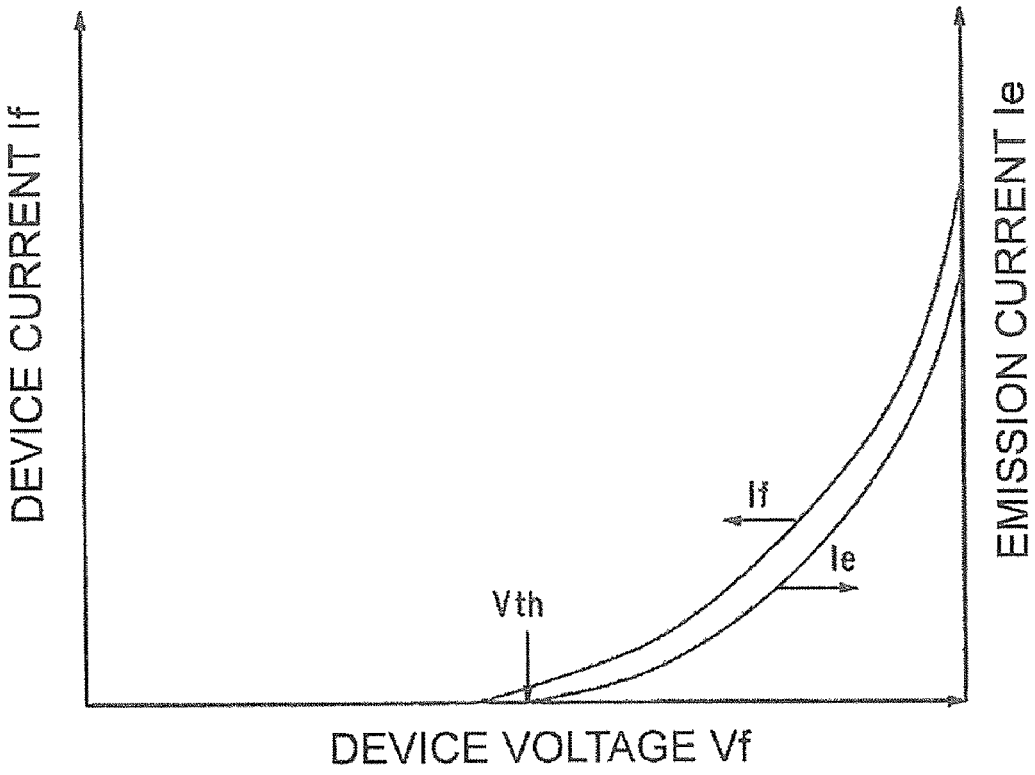
FIG. 5 is a diagram showing electron emission characteristics of an electron-emitting device in the present invention.

FIG. 5 shows a typical example of a relationship between the emission current Ie and device current If measured by the measurement evaluation apparatus shown in FIG. 4 and the device voltage Vf. Though the emission current Ie and device current If are significantly different in magnitude, the vertical axes are scaled in arbitrary units on a linear scale in FIG. 5 to qualitatively compare changes of If and Ie.

The electron-emitting device has three features for the emission current Ie.

First, as is evident from FIG. 5, the emission current Ie rapidly increases when a device voltage of a certain value (hereinafter called the threshold voltage, Vth in FIG. 5) is applied to the device, but the emission current Ie is hardly detected when the applied voltage is the threshold voltage Vth or less. That is, the device shows a property as a nonlinear device having the definite threshold voltage Vth for the emission current Ie.

Second, the emission current Ie is dependent on the device voltage Vf and thus, the emission current Ie can be controlled by the device voltage Vf.

Third, emission charges captured by an anode electrode 54 are dependent on the time during which the device voltage Vf is applied. That is, the charge quantity captured by the anode electrode 54 can be controlled by the time during which the device voltage Vf is applied.

Next, an image display apparatus in the present invention will be described.

The image display apparatus in the present invention has a first plate on which a plurality of the electron-emitting devices in the present invention is arranged and a second plate on which an image display member irradiated with electrons emitted from the electron-emitting devices is arranged and which is arranged opposite to the electron-emitting devices.

Figure 6:
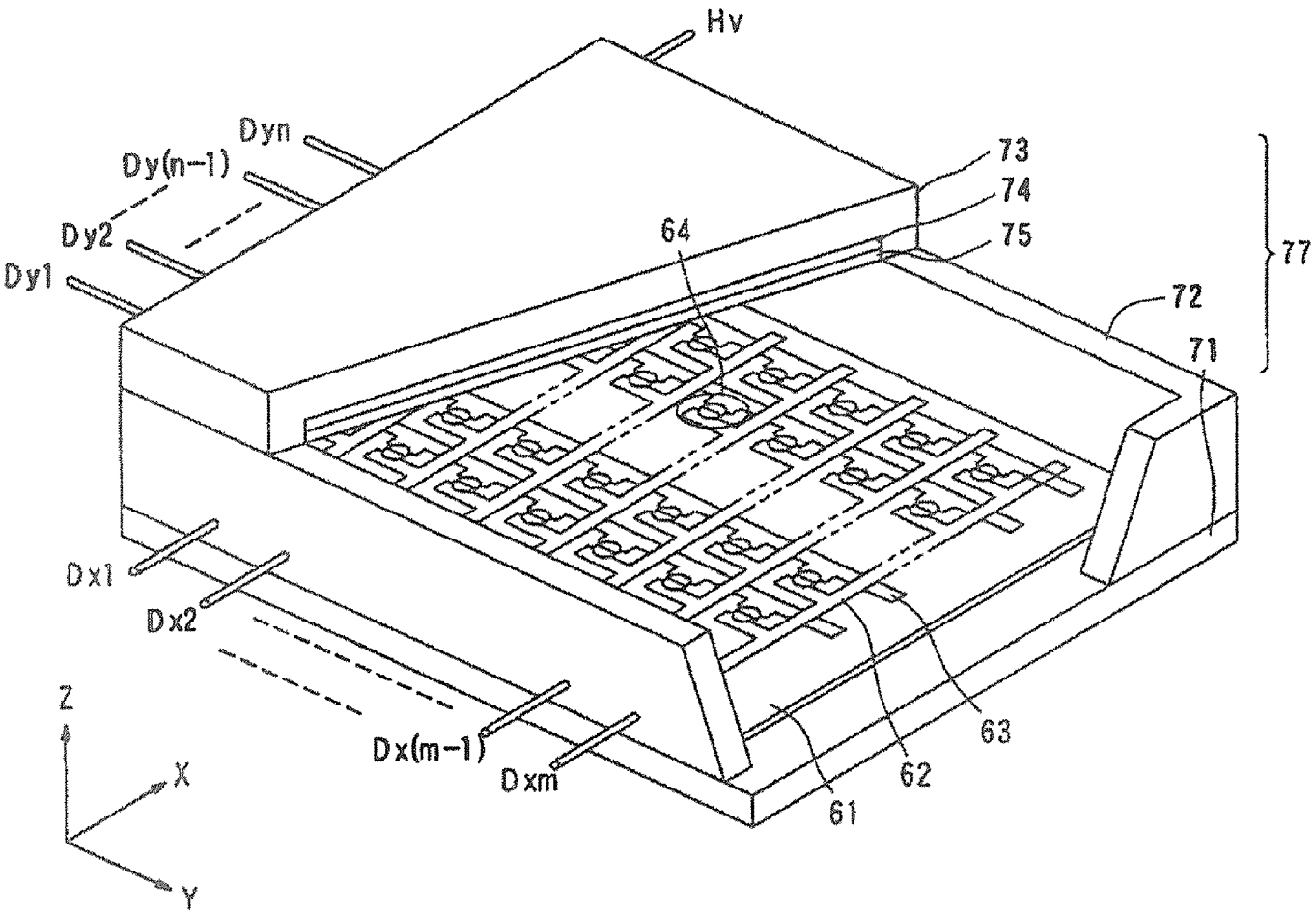
FIG. 6 is a perspective view showing the configuration of a display panel of an image display apparatus in the present invention.

FIG. 6 is a perspective view showing the configuration of a display panel of an image display apparatus in the present invention. Reference numeral 61 in FIG. 6 denotes an electron source substrate, reference numeral 62 denotes an X-direction wiring (upper wiring), reference numeral 63 denotes a Y-direction wiring (lower wiring), and reference numeral 64 denotes an electron-emitting device.

As shown in FIG. 6, the electron source substrate on which a plurality of the electron-emitting devices 64 is arranged and connected in a matrix is mounted on a rear plate (first plate) 71. The configuration of each electron-emitting device is the same as that shown in FIG. 1A.

Also in FIG. 6, a phosphor film (image display member) 74, a metal back 75 and the like are formed on an inside surface of a face plate (second plate) 73 made of a glass plate. Reference numeral 72 denotes a supporting frame. The rear plate 71, the supporting frame 72, and the face plate 73 are adhered by frit glass and burned at 400° C. to 500° C. for 10 min or longer for sealing to form an envelope 77.

By setting up a supporting member (not shown) called a spacer between the face plate 73 and the rear plate 71, the envelope 77 having sufficient strength against atmospheric pressure for a large-area panel may be formed.

Figure 7A:
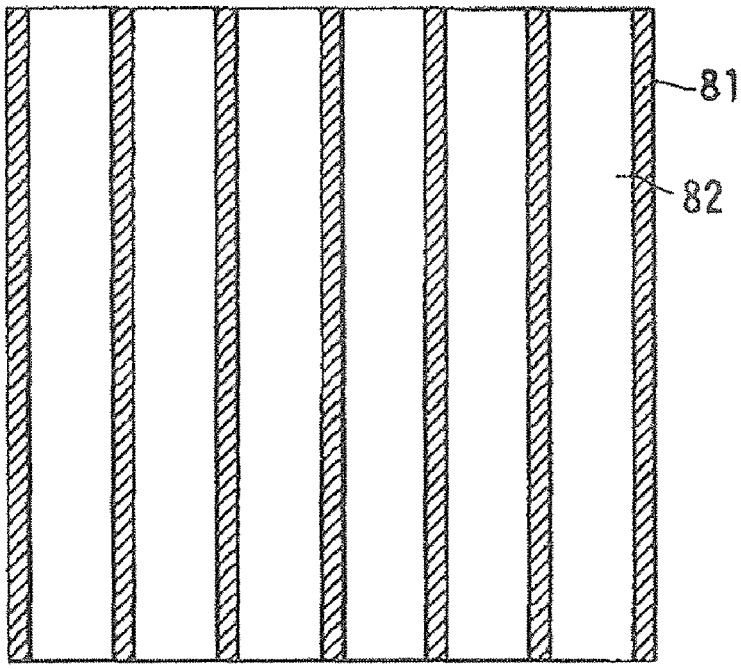
FIG. 7A and FIG. 7B are illustrative diagrams of a phosphor film, which is a component member of an image display apparatus in the present invention.
Figure 7B:
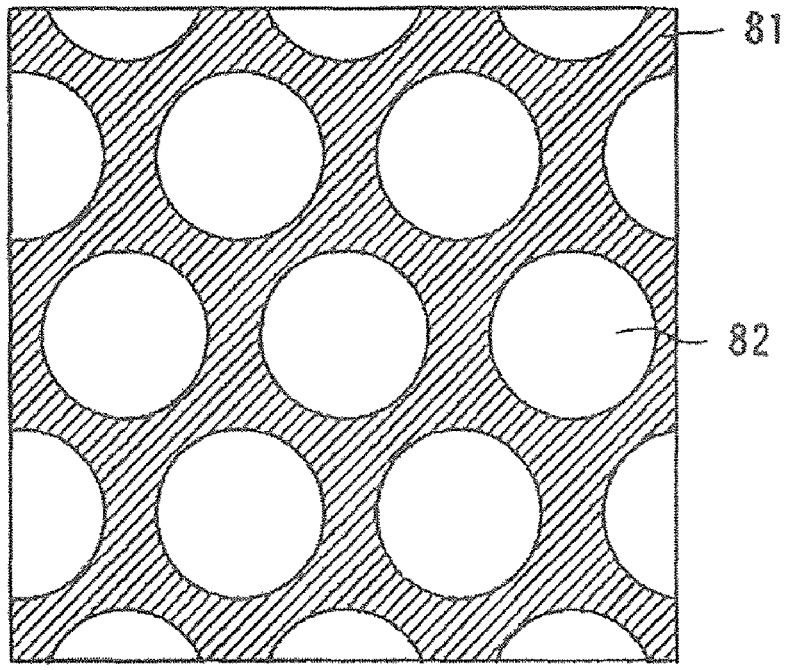

FIG. 7 is an illustrative diagram of the phosphor film 74 of the face plate 73. The phosphor film 74 is made of only a phosphor for a monochrome phosphor film. For a color phosphor film, the phosphor film 74 is formed from a black conductive material 81 called a black stripe or black matrix by arrangement of phosphors and a phosphor 82. The black stripe or black matrix is provided in order to make a color mixture and the like less conspicuous by blackening a portion where distinguished by different colors between the phosphors 82 of trichromatic phosphors required for a color display. In addition, the black stripe or black matrix is provided in order to control degradation of contrast by outside light reflection at the phosphor film 74.

The metal back 75 is usually provided on the inside surface of the phosphor film 74. The metal back is provided in order to improve brightness by specular reflection, among emissions of light by phosphors, of light to the inside surface side to the face plate 73 side, to act as an anode electrode to which an electron beam acceleration voltage is applied, and the like. The metal back 75 can be produced by, after a phosphor film being produced, performing smoothing (usually called filming) of the surface on the inside of the phosphor film and then depositing Al by vacuum deposition or the like.

When the envelope 77 is sealed, phosphors of each color and electron-emitting devices must be matched for a color phosphor film and thus, adequate positioning by bumping upper and lower plates against each other or the like is needed.

In order to maintain a degree of vacuum after the envelope 77 being sealed, in addition to the degree of vacuum of about $10^{-5}$ Pa being needed for sealing, getter treatment may be performed. This is a treatment to form an evaporated film by heating a getter arranged at a predetermined position (not shown) inside the envelope immediately before or after the envelope 77 being sealed by a heating method of resistance heating, high-frequency heating and the like. The getter usually has Ba as a main component and maintains the degree of vacuum by adsorption of the evaporated film.

According to the basic features of the electron-emitting device in the present invention, emission electrons from the electron-emitting portion are controlled by the wave height and width of a pulse voltage applied between electrodes facing each other when the applied voltage is the threshold voltage or more. The current amount is controlled also by a mean value thereof and thus, a halftone display is enabled.

When a large number of electron-emitting devices are arranged, a voltage can be applied to any device as needed by determining an selection line by a scanning line signal and applying the pulse voltage to individual devices through each information signal line as needed so that each device can be turned on.

Methods of modulating an electron-emitting device in accordance with an input signal having halftones include the voltage modulation method and the pulse width modulation method.

A specific driving device will be described below.

Figure 8:
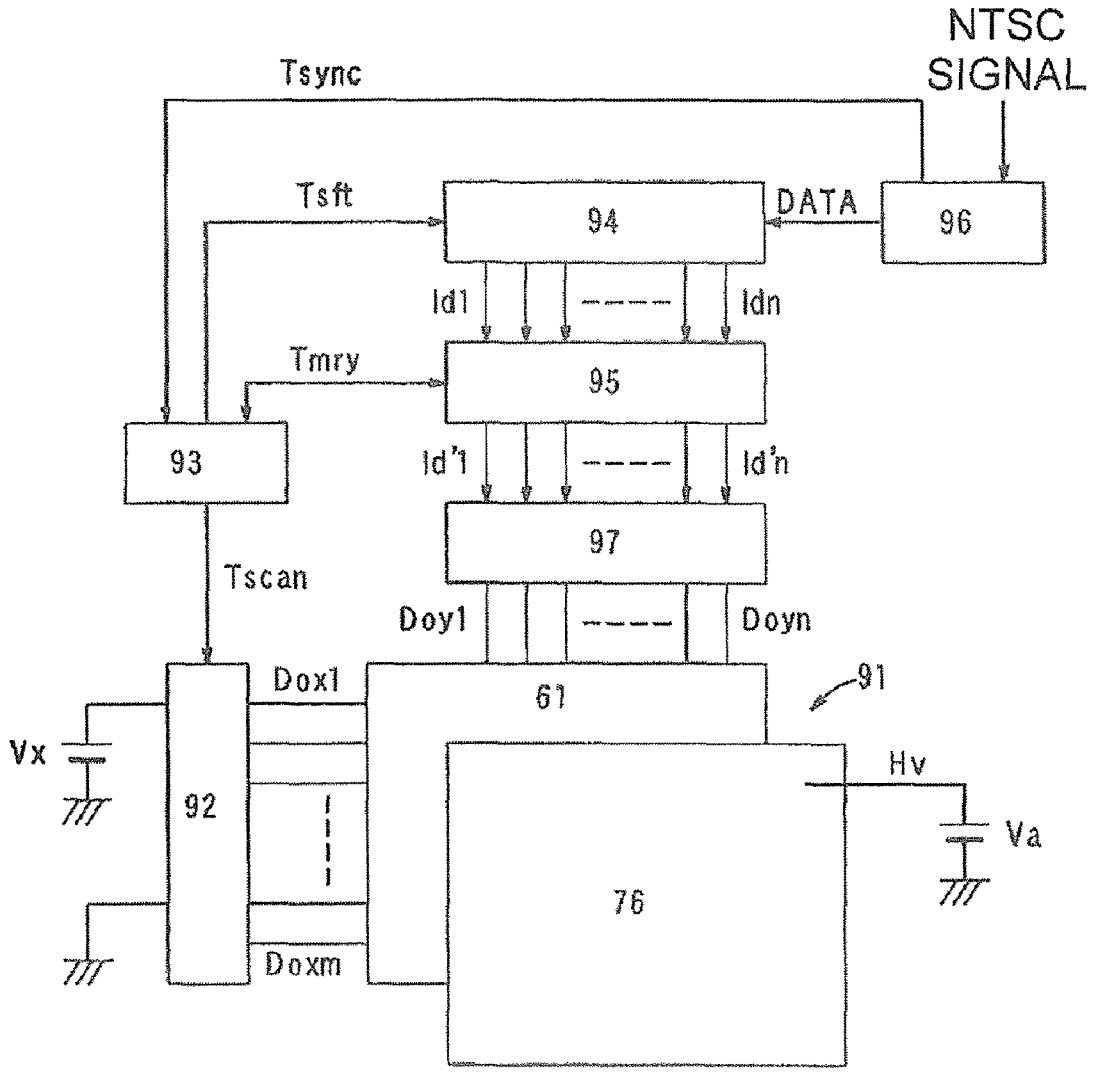
FIG. 8 is a diagram showing a configuration example of an image display apparatus in the present invention.

FIG. 8 shows a configuration example of an image display apparatus for TV display based on NTSC TV signals using a display panel constructed by using an electron source substrate of simple matrix arrangement.

In FIG. 8, reference numeral 91 denotes an image display panel as shown in FIG. 7, reference numeral 92 denotes a scanning circuit, reference numeral 93 denotes a control circuit, reference numeral 94 denotes a shift register, reference numeral 95 denotes a line memory, reference numeral 96 denotes a synchronous signal separation circuit, reference numeral 97 denotes an information signal generator, and Va denotes a DC voltage source.

The scanning circuit 92 as an X driver applying a scanning line signal is connected to the X-direction wiring of the image display panel 91 using the electron source substrate and the information signal generator 97 as the Y driver applying an information signal is connected to the Y-direction wiring.

To apply the pulse height modulation method, a circuit that generates fixed width voltage pulses and modulates the wave height of pulses as needed in accordance with input data is used as the information signal generator 97. To apply the pulse width modulation method, a circuit that generates fixed height voltage pulses and modulates the width of voltage pulses as needed in accordance with input data is used as the information signal generator 97.

The control circuit 93 generates each control signal of Tscan, Tsft, and Tmry to each component based on a synchronous signal Tsync sent from the synchronous signal separation circuit 96.

The synchronous signal separation circuit 96 is a circuit for separating an NTSC TV signal input from outside into a synchronous signal component and a luminance signal component. The luminance signal component is input into the shift register 94 in synchronization with the synchronous signal.

The shift register 94 performs serial/parallel conversion of the luminance signal input in serial and time series for each line of image and operates based on a shift clock Tsft sent from the control circuit 93. Serial/parallel converted data of one line of image (corresponding to drive data for n electron-emitting devices) is output from the shift register 94 as n parallel signals.

The line memory 95 is a storage device for storing data of one line of image for a required time and stored content is input into the information signal generator 97.

The information signal generator 97 is a signal source for suitably driving each electron-emitting device in accordance with each luminance signal. An output signal thereof enters the display panel 91 through the Y-direction wiring and is applied to each electron-emitting device present at intersections with the X-direction wiring being selected by the scanning circuit 92.

By scanning the X-direction wiring successively, it becomes possible to drive electron-emitting devices on the whole panel.

In the image display apparatus according to the present invention, as described above, each electron-emitting device is caused to emit electrons by applying a voltage through the X— and Y-direction wirings. On the other hand, a high voltage is applied to the metal back 75, which is an anode electrode, through a high-voltage terminal Hv connected to the DC voltage source Va to accelerate a generated electron beam. An image can be formed by collision of the electron beam against the phosphor film 74.

The configuration of the image display apparatus described here is an example of the image display apparatus in the present invention and various modifications can be made based on technical ideas of the present invention. NTSC input signals are described above, but input signals are not limited to NTSC input signals and the present invention can be applied also to PAL, HDTV and the like.

EXAMPLE 1

The process of producing an electron-emitting device in the configuration shown in FIG. 1 was performed up to the process before forming the electron-emitting portion 5.

2.8 mm thick glass of PD-200 (trade name, manufactured by Asahi Glass Co., Ltd.) having less alkali components was used as the substrate 1 with further 100 nm of $SiO_2$ film applied and burned as a sodium block layer thereon.

Next, a film of titanium Ti as an undercoating layer was formed by the sputtering method on the glass substrate 1 to a thickness of 5 nm and a film of platinum Pt to a thickness of 40 nm. Then, a photo resist was applied and a series of photolithographic processes of exposure, development, and etching was applied for patterning to form the device electrodes 2, 3.

In the present example, the distance L of the device electrodes was set to 10 μm and the width W to 100 μm.

After the substrate being sufficiently cleaned, the substrate was put into a vessel in which vapor of diacetoxy dimethyl silane was saturated and left at room temperature (about 25° C.) for 30 min. Then, the substrate was taken out of the vessel, heated at 120° C. for 15 min, and a silane coupling agent was used to treat the surface of the substrate.

Next, 0.624 g of palladium-proline complex, 0.286 g of chrome EDTA complex, 0.1 g of 88% saponified polyvinyl alcohol (average polymerization degree: 500), 2 g of ethylene glycol, and 15 g of 2-propanol were dissolved in water to make a solution of 100 g. The solution was filtered by a membrane filter of pore size 0.25 μm after dissolution to make a palladium/chrome compound solution (a solution in which the molar ratio of Pd metal and Cr metal is 70:30). The solution was attached between the device electrodes 2, 3 by using an inkjet injection system using a piezo element and adjusting the dot diameter to 60 μm. A substrate was prepared, on which the solution was applied with changing the number of dots (droplets). Pd and Cr oxide were formed between the device electrodes 2, 3 by heating the substrate in an oven in the atmosphere at 350° C. for 30 min.

The substrate was put into a vacuum chamber and baked at substrate temperature of 300° C. and $1\times10^{-5}$ Pa or less for 10 hours. The length of obtained device of conductive films made of Pd and Cr oxide was observed under an optical microscope and measured, yielding the dot diameter of 60 μm. Measurement of sheet resistance of the conductive films showed 2.60 kΩ/sq in 4-dot case, 2.94 kΩ/sq in 3-dot case, and 4.80 kΩ/sq in 2-dot case.

Quantitative analysis of each conductive film by an X ray microanalyzer (EPMA) was performed to determine the abundance of Pd and Cr metals. Abundances of elements were: $60.3\times10^{15}$ atoms/cm$^2$ in 4-dot case, $43.3\times10^{15}$ atoms/cm$^2$ in 3-dot case, and $28.6\times10^{15}$ atoms/cm$^2$ in 2-dot case.

Figure 9:
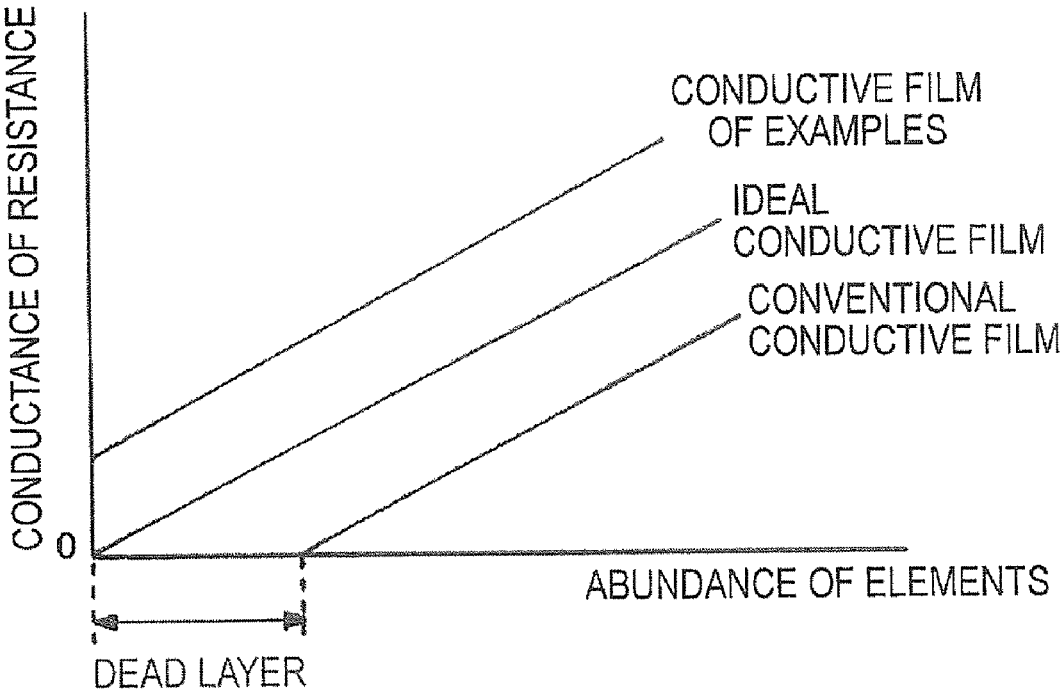
FIG. 9 is a diagram showing conductance curves showing a relationship between an abundance of elements and sheet resistance of conductive films produced in an example of the present invention.

The above result was used for plotting with the horizontal axis set as the abundance of elements and the vertical axis set as an inverse of sheet resistance to determine an approximated straight line (hereinafter referred to as a conductance curve). FIG. 9 shows the conductance curves.

A conductance curve shows a relationship between a metal abundance and an inverse of resistance. If the metal abundance increases, resistance decreases and an inverse of resistance increases. If the metal abundance decreases, resistance increases. If the abundance is 0, resistance is infinite and an inverse thereof is 0. In an ideal system, the conductance curve is a straight line passing through the origin. Generally, resistance increases before the metal abundance decreases to 0, and the y-intercept becomes a negative value. A point of intersection with the x axis is a dead layer where resistance becomes infinite even if metal is present. A material of the present invention is a material that presents no dead layer even if the metal abundance decreases in the range of two to four dots. A material of the present invention has a positive-valued dead layer.

In the present example, the y-intercept of an approximated curve was a positive value. Also, XPS analysis of the film state showed that the abundance of Cr decreased in the depth direction.

EXAMPLE 2

0.491 g of palladium-proline complex 0.579 g of chrome EDTA complex, 0.1 g of 88% saponified polyvinyl alcohol (average polymerization degree: 500), 2 g of ethylene glycol, and 15 g of 2-propanol were dissolved in water to make a solution of 100 g. The solution was filtered by a membrane filter of pore size 0.25 μm after dissolution to make a palladium/chrome compound solution (a solution in which the molar ratio of Pd metal and Cr metal is 65:35) and applied to the substrate by changing the number of dots according to a method similar to that in Example 1. After being burnt at 350° C., the substrate was baked at 330° C. for 10 hours in a vacuum chamber. Then, resistance was measured. Sheet resistance of obtained conductive films was 13.5 kΩ/sq in 2-dot case, 8.87 kΩ/sq in 3-dot case, and 7.20 kΩ/sq in 4-dot case. The metal abundance was determined by EPMA to also determine the abundance of elements. The result was $38.6\times10^{15}$ atoms/cm$^2$ in 2-dot case, $56.8\times10^{15}$ atoms/cm$^2$ in 3-dot case, and $75.9\times10^{15}$ atoms/cm$^2$ in 4-dot case.

Similarly to Example 1, the above result was used for plotting with the horizontal axis set as the abundance of elements and the vertical axis set as an inverse of sheet resistance to determine a conductance curve thereof. As a result, the y-intercept of an approximated curve was a positive value. Also, XPS analysis of the film state showed that the abundance of Cr decreased in the depth direction.

EXAMPLE 3

0.453 g of palladium-proline complex, 0.662 g of chrome EDTA complex, 0.1 g of 88% saponified polyvinyl alcohol (average polymerization degree: 500), 2 g of ethylene glycol, and 15 g of 2-propanol were dissolved in water to make a solution of 100 g. The solution was filtered by a membrane filter of pore size 0.25 μm after dissolution to make a palladium/chrome compound solution (a solution in which the molar ratio of Pd metal and Cr metal is 60:40) and applied to the substrate by changing the number of dots according to a method similar to that in Example 1. After being burnt at 350° C. while being irradiated with UV, the substrate was baked at 350° C. for 10 hours in a vacuum chamber. Then, resistance was measured. Sheet resistance of obtained conductive films was 46.1 kΩ/sq in 2-dot case, 31.5 kΩ/sq in 3-dot case, and 24.4 kΩ/sq in 4-dot case. The metal abundance was determined by EPMA to also determine the abundance of elements. The result was $45.2\times10^{15}$ atoms/cm$^2$ in 2-dot case, $64.1\times10^{15}$ atoms/cm$^2$ in 3-dot case, and $87.4\times10^{15}$ atoms/cm$^2$ in 4-dot case.

Similarly to Example 1, the above result was used for plotting with the horizontal axis set as the abundance of elements and the vertical axis set as an inverse of sheet resistance to determine a conductance curve thereof. As a result, the y-intercept of an approximated curve was a positive value. Also, XPS analysis of the film state showed that the abundance of Cr decreased in the depth direction.

EXAMPLE 4

0.507 g of palladium-proline complex, 0.543 g of chrome EDTA complex, 0.1 g of 88% saponified polyvinyl alcohol (average polymerization degree: 500), 2 g of ethylene glycol, and 15 g of 2-propanol were dissolved in water to make a solution of 100 g. The solution was filtered by a membrane filter of pore size 0.25 μn after dissolution to make a palladium/chrome compound solution (a solution in which the molar ratio of Pd metal and Cr metal is 50:50) and applied to the substrate by changing the number of dots according to a method similar to that in Example 1. After being burnt at 350° C. while being irradiated with UV, the substrate was baked at 330° C. for 10 hours in a vacuum chamber. Then, resistance was measured. Sheet resistance of obtained conductive films was 280 kΩ/sq in 2-dot case, 205 kΩ/sq in 3-dot case, and 162 kΩ/sq in 4-dot case. The metal abundance was determined by EPMA to also determine the abundance of elements. The result was $44.2\times10^{15}$ atoms/cm$^2$ in 2-dot Case, $66.4\times10^{15}$ atoms/cm$^2$ in 3-dot case, and $86.5\times10^{15}$ atoms/cm$^2$ in 4-dot case.

Similarly to Example 1, the above result was used for plotting with the horizontal axis set as the abundance of elements and the vertical axis set as an inverse of sheet resistance to determine a conductance curve thereof. As a result, the y-intercept of an approximated curve was a positive value. Also, XPS analysis of the film state showed that the abundance of Cr decreased in the depth direction.

EXAMPLE 5

An experiment similar to that in Example 1 was performed by replacing a palladium/chrome compound solution applied by an inkjet injection system with a platinum/chrome compound solution shown below.

0.412 g of platinum acetate monoethanol complex, 0.662 g of chrome EDTA, 0.1 g of 88% saponified polyvinyl alcohol (average polymerization degree: 500), 2 g of ethylene glycol, and 15 g of 2-propanol were dissolved in water to make a solution of 100 g. The solution was filtered by a membrane filter of pore size 0.25 μm after dissolution to make a platinum/chrome compound solution (a solution in which the molar ratio of Pt metal and Cr metal is 60:40) and applied to the substrate by changing the number of dots according to a method similar to that in Example 1. The substrate was burned in the atmosphere at 350° C. Measurement of sheet resistance resulted in 44.3 kΩ/sq in 2-dot case, 24.1 kΩ/sq in 3-dot case, and 19.0 kΩ/sq in 4-dot case. The metal abundance was determined by EPMA to also determine the abundance of elements. The result was $20.0\times10^{15}$ atoms/cm$^2$ in 2-dot case, $32.5\times10^{15}$ atoms/cm$^2$ in 3-dot case, and $45.0\times10^{15}$ atoms/cm$^2$ in 4-dot case.

Similarly to Example 1, the above result was used for plotting sheet resistance and the abundance of elements with the horizontal axis set as the abundance of elements and the vertical axis set as an inverse of sheet resistance to determine a conductance curve thereof. As a result, the y-intercept of an approximated curve was a positive value. Also, XPS analysis of the film state showed that the abundance of Cr decreased in the depth direction.

Similarly, with respect to metals of V, Cr, Ti, Mg, Mo, Ca, Ba, Y, and In, solution was prepared by mixing palladium-proline complex and EDTA complex of the metal in the ratio of 70:30. The solution was applied as two dots, three dots, and four dots by an inkjet injection system to the substrate. After being burnt at 350° C., the substrate was put into a vacuum chamber and baked at 300° C. for 10 hours. Then, sheet resistance of obtained conductive films was measured. Similarly to Example 1, the above result was used for plotting with the horizontal axis set as the abundance of elements and the vertical axis set as an inverse of sheet resistance to determine a conductance curve thereof. As a result, the y-intercept of an approximated curve was a positive value.

In a conductive film according to the present invention, as described above, the y-intercept of a conductance curve is a positive value and the rate of change of thickness was larger than that of resistance.

EXAMPLE 6

Figure 10:
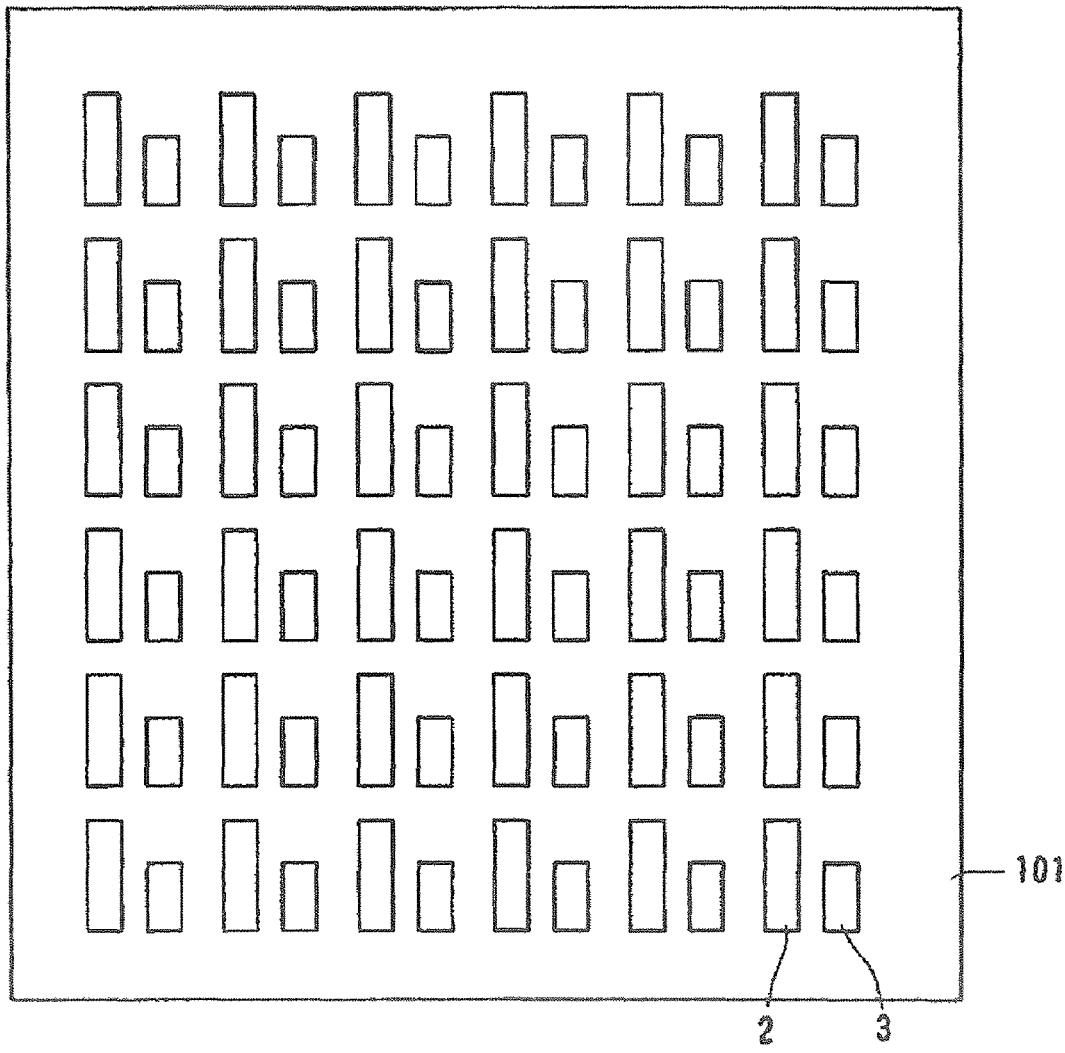
FIG. 10 is a plane schematic diagram showing a manufacturing process of an electron source substrate in an example of the present invention.

As shown in FIG. 10, the device electrodes 2, 3 made of Pt having a thickness of 40 nm were formed using the sputtering method and liftoff method on a glass substrate 101.

Figure 11:
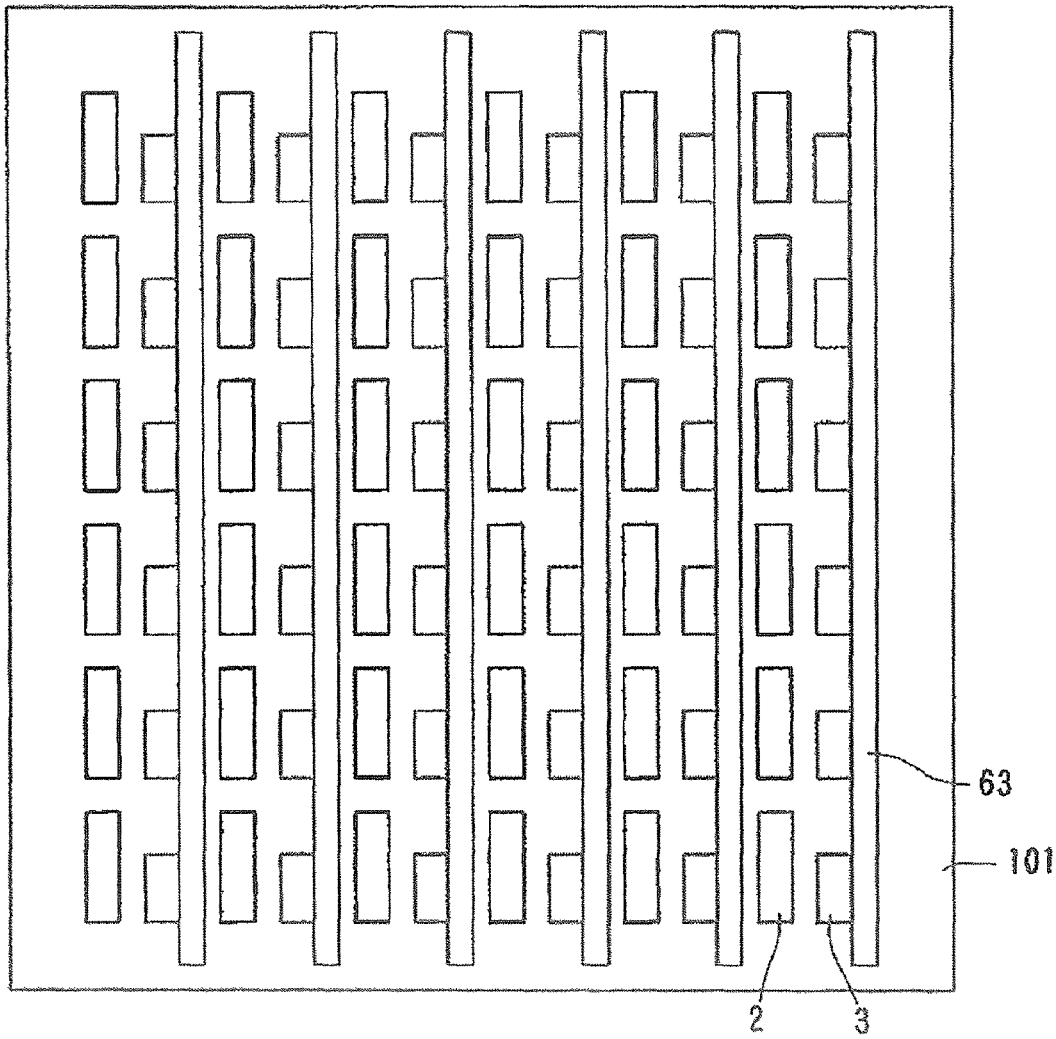
FIG. 11 is a plane schematic diagram showing the manufacturing process of the electron source substrate in an example of the present invention.

A paste material (NP-4035C manufactured by Noritake Co., Limited) was printed on the substrate using a technique of screen printing and the substrate was burned at 450° C. to form a Y-direction wiring 63 having a thickness of 10 μm as shown in FIG. 11. The Y-direction wiring 63 was made to have an electrical connection with the device electrode 2.

Figure 12:
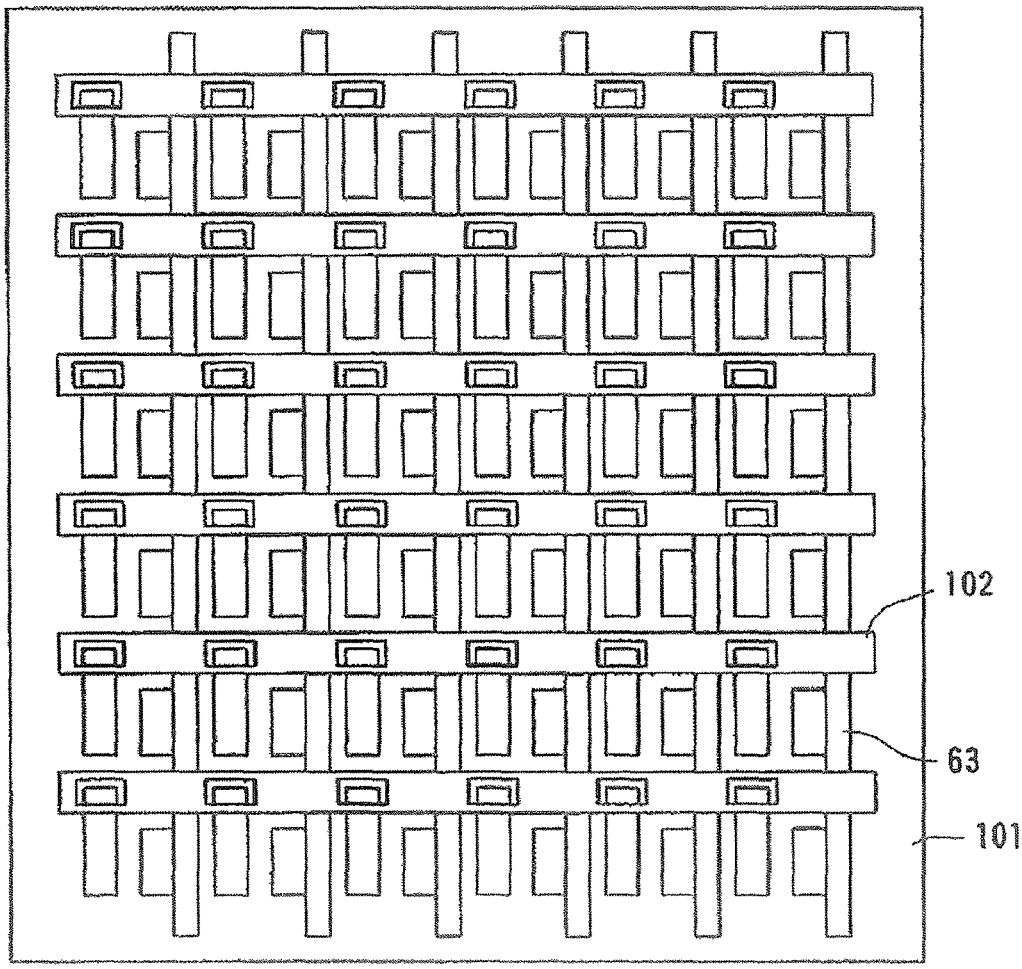
FIG. 12 is a plane schematic diagram showing the manufacturing process of the electron source substrate in an example of the present invention.

A paste material (NP-7710 manufactured by Noritake Co., Limited) was printed on the substrate using a technique of screen printing and the substrate was burned at 570° C. to form an insulating film 102 having a thickness of 20 μm as shown in FIG. 12.

Figure 13:
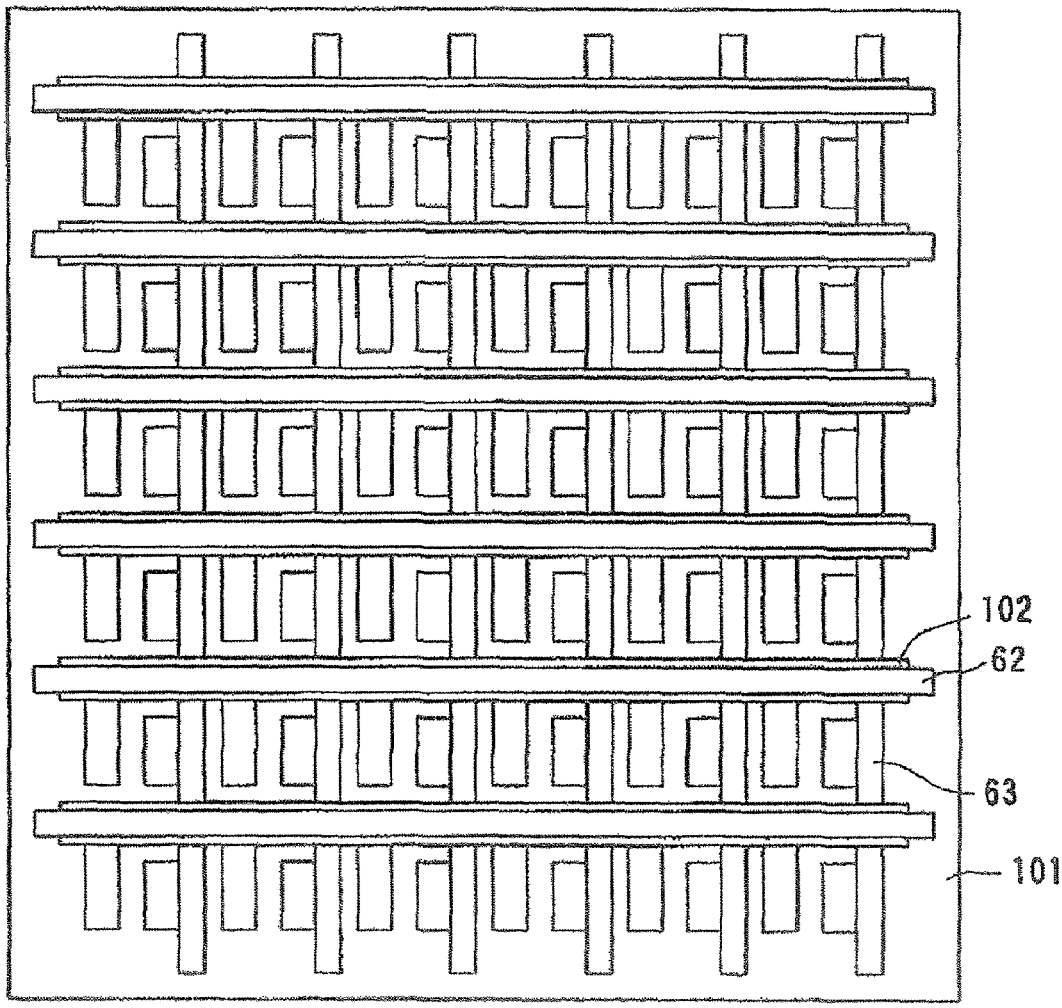
FIG. 13 is a plane schematic diagram showing the manufacturing process of the electron source substrate in an example of the present invention.

A paste material (NP-4035C manufactured by Noritake Co., Limited) was printed on the substrate using a technique of screen printing and the substrate was burned at 450° C. to form an X-direction wiring 62 having a thickness of 10 μm as shown in FIG. 13. The X-direction wiring 62 was made to have an electrical connection with the device electrode 3. The Y-direction wiring 63 and the X-direction wiring 62 were made to be insulated by the insulating film 102. In a manner described above, a 100×100 matrix substrate was produced.

After the substrate on which the device electrodes 2, 3 and the wirings 62, 63 prepared as described above being cleaned, the surface thereof was treated. The surface treatment process is performed in order to stabilize and make uniform the shape of droplets in a conductive film production process by an inkjet injection system described later. Specifically, the surface treatment process was performed by leaving the substrate in a vessel filled with saturated vapor of dimethyl dimethoxysilane at room temperature (about 25° C.) for 30 min.

After the surface treatment, four droplets of palladium/chrome compound solution used in Example 3 were applied at a time between the device electrodes 2, 3 on the substrate. Droplets applied at this point formed attached droplets by extending to a round shape of 60 μm in diameter on the substrate, each overlapping ends of the device electrodes 2, 3.

Figure 14:
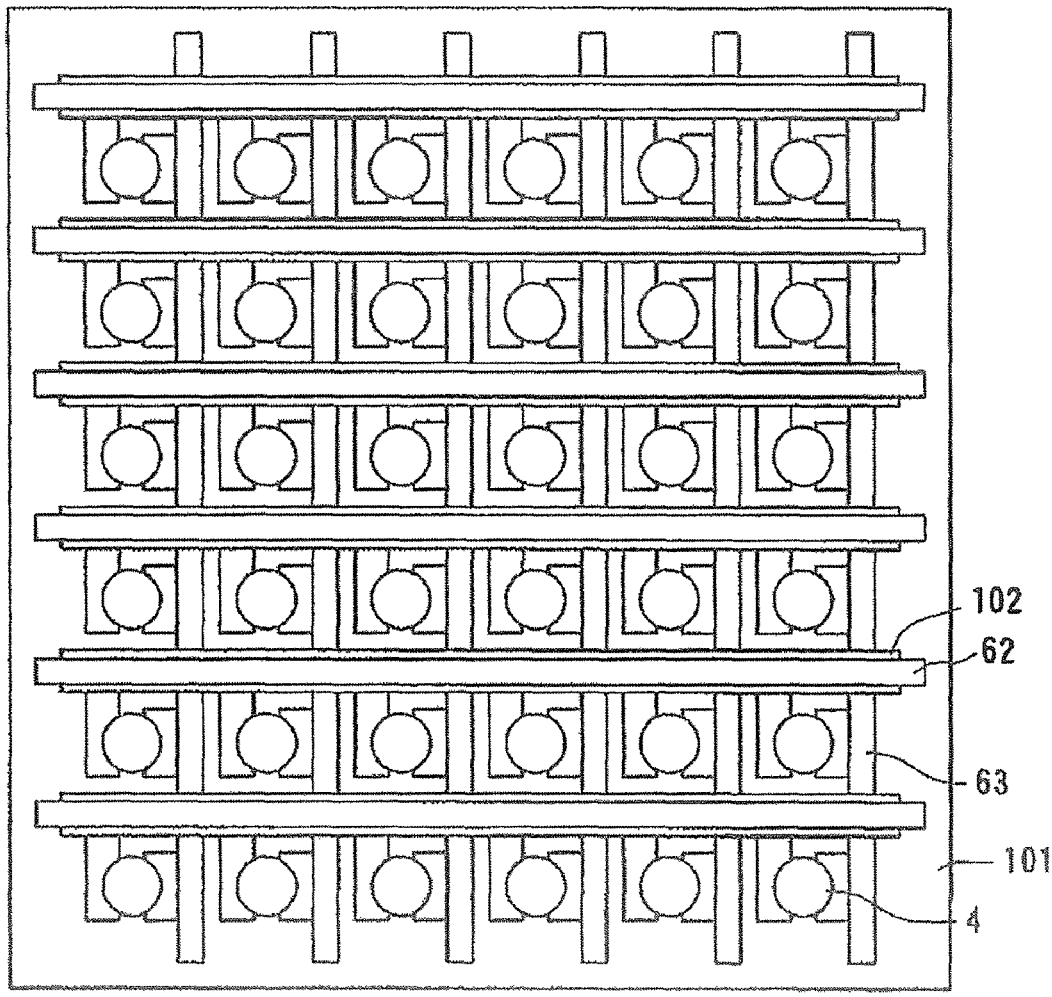
FIG. 14 is a plane schematic diagram showing the manufacturing process of the electron source substrate in an example of the present invention.

After attachment of droplets, the substrate was heated in an oven in the atmosphere at 350° C. for 30 min and then maintained in a vacuum chamber at 330° C. for 10 hours, and the temperature was dropped to the room temperature. The conductive film 4 made of palladium and chrome oxide was formed in an area linking the device electrodes 2, 3 (FIG. 14).

The substrate was taken out of the chamber and connection between the device electrodes 2, 3 and the wirings 62, 63 was treated by laser. Then, measurement of sheet resistance of each of 20 lines of devices (2000 devices) yielded 24.4±1 kΩ/sq and fluctuations in resistance were ±4%.

EXAMPLE 7

Similarly to Example 6, the device electrodes 2, 3 and the wirings 62, 63 were formed on the glass substrate 101 and four droplets of palladium/chrome compound solution used in Example 3 were applied at a time between the device electrodes 2, 3 using an inkjet injection system.

Next, the substrate was heated in an oven in the atmosphere at 350° C. for 30 min while being irradiated with UV. The substrate formed in this manner was maintained in a vacuum chamber. The X-direction wiring 62 and the Y-direction wiring 63 were respectively connected to a group of probes in the chamber so that energization and resistance measurement could be performed from outside the chamber. Air was exhausted from inside the chamber using a turbo molecular pump and a scroll pump until pressure inside the chamber reached $1\times10^{-6}$ Pa or less. Subsequently, the temperature of the stage was increased to heat the substrate. The temperature was increased from the room temperature to 300° C. in three hours and kept at 300° C. for 10 hours. Then, the temperature was decreased to finish the heating. Palladium oxide was reduced by the heating process in a vacuum and the conductive film 4 made of palladium and chrome oxide was formed.

Subsequently, the electron-emitting portion 5 was formed in the conductive film 4 by the following forming process while keeping a vacuum state inside the chamber.

Figure 15:
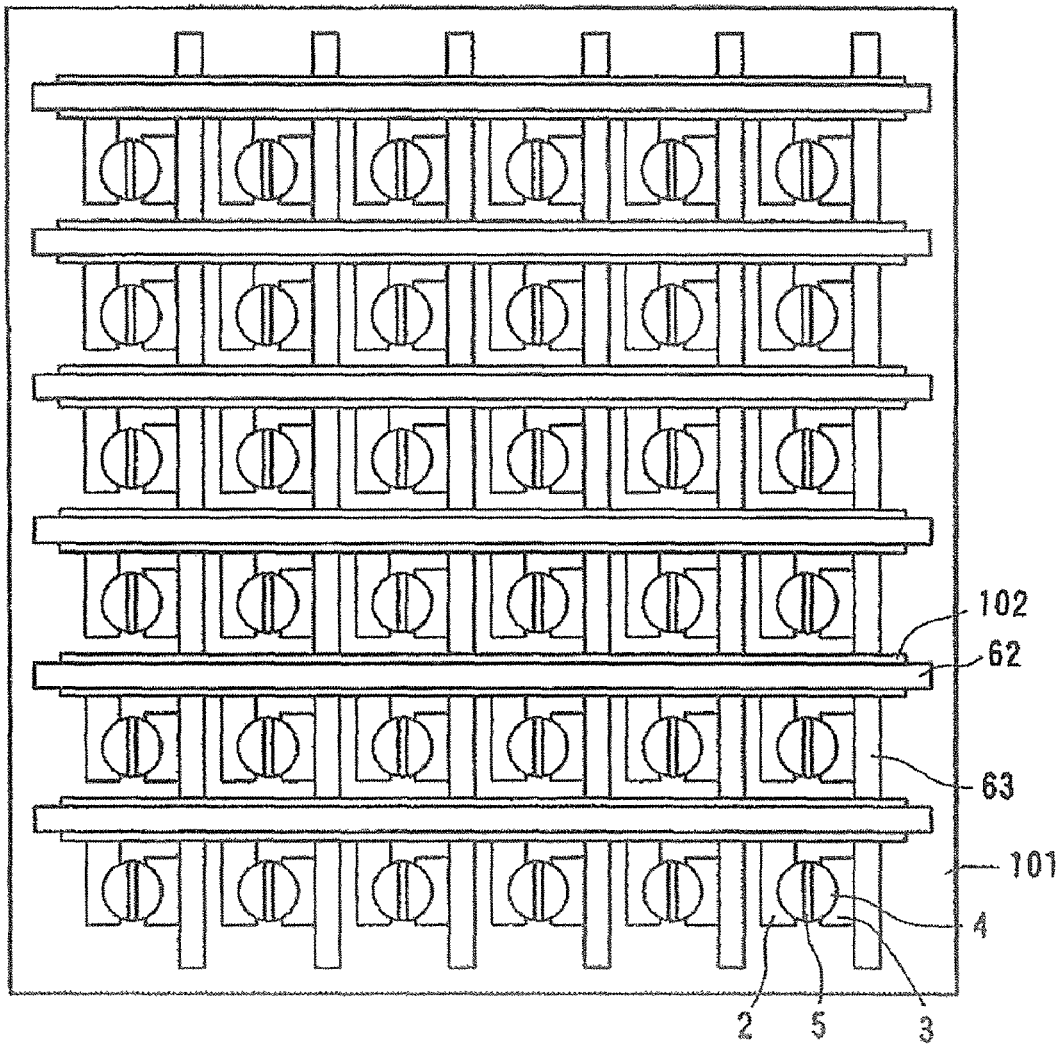
FIG. 15 is a plane schematic diagram showing the electron source substrate fabricated in an example of the present invention.

The voltage applied to each device had rectangular waveforms. Pulses with the pulse width of 0.1 ms and pulse interval of 50 ms were applied. Voltage application started with 1 V and was increased by 0.1 V every five seconds until the voltage reached 20 V when the voltage application was finished. When the voltage of about 13 to 15 V was applied in the course of increasing the voltage, a forming gap was formed in the conductive film 4 due to an influence of Joule heat resulting from energization and when the voltage application was finished, resistance of the conductive film 4 rose to 1 MΩ or more in all lines. In this manner, as shown in FIG. 15, the electron-emitting portion 5 was formed in the center of the conductive film 4.

Subsequently, tolunitrile vapor was introduced into the chamber at the partial pressure of $1.3\times10^{-4}$ Pa and a pulse voltage was applied to the conductive film 4 for 30 min for activation. Rectangular pulses of 18 V and 1 ms and those of −18 V and 1 ms were alternately applied at 100 Hz. This treatment was to cause carbon to deposit near the electron-emitting portion 5 formed on the substrate to increase the amount of electron emission. Observation of a device current during the activation process showed a uniform increase in current in the whole conductive film 4.

With the above processes, a surface conduction electron source substrate having no non-uniform electron emission efficiency of individual electron-emitting devices on the substrate could be formed.

Further, using the electron source substrate, an image display apparatus as shown in FIG. 6 was fabricated. The surface conduction electron source substrate was housed inside the rear plate 71, the supporting frame 72, and the face plate 73 made of glass material and each member was adhered together. Frit glass was used for adhesion and each member was heated to 450° C. for adhesion. The metal back 75 and the phosphor film 74 were formed inside the face plate 73 and the high-voltage terminal connected to the metal back 75 was structured to be pulled out of the display panel. The wirings 62, 63 formed on the electron source substrate 61 were structured to be connected to an X-direction terminal Dx1 to Dxm and a Y-direction terminal Dy1 to Dyn extending out of the display panel respectively. Further air inside was exhausted by a vacuum pump through an exhaust pipe (not shown). The image display apparatus was completed by welding the exhaust pipe using a gas burner. Images were displayed by providing a potential of 4 kV to the metal back 75 of the image display apparatus via the high-voltage terminal and inputting an image signal to the X-direction terminal Dx1 to Dxm and the Y-direction terminal Dy1 to Dyn.

As a result, it was observed that a uniform display without non-uniformity was achieved over the whole display screen.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-207347, filed on Aug. 9, 2007, which is hereby incorporated by reference in its entirety.

What is claimed is:

1. An electron-emitting device, comprising:

a pair of device electrodes formed on an insulating substrate; and a conductive film formed to connect the device electrodes and having an electron-emitting portion, wherein the conductive film has a thickness of 3 nm to 50 nm and is made of precious metal and oxide of base metal, a percentage of the base metal among metals contained in the conductive film is 30 mol % or more, and the conductive film has a concentration gradient of the oxide of the base metal in a thickness direction.

2. An electron-emitting device according to claim 1, wherein the precious metal is at least one selected from Pt, Pd, Ir, and Rh.

3. An electron-emitting device according to claim 1, wherein the base metal is at least one selected from V, Cr, Ti, Mg, Mo, Ca, Ba, Y, and In.

4. An image display apparatus, comprising:

a first plate having a plurality of the electron-emitting devices according to claim 1; and a second plate having an image display member irradiated with electrons emitted from the electron-emitting devices and arranged opposite to the first plate.

* * * * *